US011844472B2

(12) United States Patent
Mustafa

(10) Patent No.: US 11,844,472 B2
(45) Date of Patent: Dec. 19, 2023

(54) FOOT-WASHING BOWL SYSTEM

(71) Applicant: Afzaal Mustafa, Islamabad (PK)

(72) Inventor: Afzaal Mustafa, Islamabad (PK)

( * ) Notice: Subject to any disclaimer, the term of this patent is extended or adjusted under 35 U.S.C. 154(b) by 0 days.

(21) Appl. No.: 17/870,895

(22) Filed: Jul. 22, 2022

(65) Prior Publication Data

US 2023/0033712 A1 Feb. 2, 2023

(51) Int. Cl.

| | |
|---|---|
| ***A47K 3/022*** | (2006.01) |
| ***A47K 3/03*** | (2006.01) |
| ***E03D 9/00*** | (2006.01) |

(52) U.S. Cl.

CPC ..... *A47K 3/022* (2013.01); *A47K 3/03* (2013.01); *E03D 9/00* (2013.01)

(58) Field of Classification Search

CPC ..... A47K 3/03; A47K 3/022

See application file for complete search history.

(56) References Cited

U.S. PATENT DOCUMENTS

| | | | | |
|---|---|---|---|---|
| 1,105,365 | A * | 7/1914 | McQuhae | A47K 3/022 4/621 |
| 5,579,545 | A * | 12/1996 | Beard | A47K 3/125 4/574.1 |
| 11,058,260 | B2 * | 7/2021 | Murayama | E03D 11/00 |
| 11,103,042 | B1 * | 8/2021 | Smith | A45D 29/18 |
| 2005/0086738 | A1 * | 4/2005 | Gragtmans | A47K 3/022 4/622 |
| 2019/0118948 | A1 * | 4/2019 | Fullerton | A47K 17/02 |

* cited by examiner

*Primary Examiner* — Christine J Skubinna

(74) *Attorney, Agent, or Firm* — Brennan, Manna & Diamond, LLC

(57) ABSTRACT

The present invention relates to a foot-washing bowl system. The system may be comprised of a free-standing foot-washing stand and/or a toilet-mounted foot-washing stand. The free-standing foot-washing stand has a bowl that receives a water source to allow water to flow through the stand and out at least one opening of a cross-member to wash the feet of the user. The toilet-mounted embodiment features a stand identical to the free-standing stand that is further comprised of a toilet seat assembly that allows the system to attach and be used as a toilet seat.

8 Claims, 12 Drawing Sheets

FOOT-WASHING BOWL SYSTEM

CROSS-REFERENCE TO RELATED APPLICATION

The present application claims priority to, and the benefit of, Pakistan Provisional Application No. 551/2021, which was filed on Jul. 27, 2021, and is incorporated herein by reference in its entirety.

FIELD OF THE INVENTION

The present invention relates generally to the field of foot washing. More specifically, the present invention relates to a foot-washing bowl system. The system may be comprised of a free-standing foot-washing stand and/or a toilet-mounted foot-washing stand. The free-standing foot-washing stand has a bowl that receives a water source to allow water to flow through the stand and out at least one opening of a cross member to wash the feet of the user. The toilet-mounted embodiment features a stand identical to the free-standing stand that is further comprised of a toilet seat assembly that allows the system to attach and be used as a toilet seat. Accordingly, the present disclosure makes specific reference thereto. Nonetheless, it is to be appreciated that aspects of the present invention are also equally applicable to other like applications, devices, and methods of manufacture.

BACKGROUND

Many individuals wash their feet to ensure a clean body. In some religions, foot-washing is part of religious rituals. For example, in Islam ablution (wadu) is required to be done five times a day, which also requires the washing of feet. There are numerous foot-washing bowl aids in use. However, they are too heavy, large, and often require cumbersome installation including specific water and drain lines. In addition, said foot-washing bowl aids also require additional allocated installation space within the limited space available in toilets/bathrooms. Alternately, said foot-washing bowl aids are designed to be used in a shower area, where they only provide a foot stand at a certain height with no specific water drain arrangement. However, users generally wash their feet while showering by resting their feet on the foot stand.

In another method, individuals may use wash basins to wash their feet. Since the height of the wash basin may be quite high, it becomes difficult for a user to use it easily. Some users with physical conditions, such as the elderly and users of short height, cannot easily use the wash basin to wash their feet due to their respective limitations.

Therefore, there exists a long-felt need in the art for an invention that allows a user to wash their feet. There also exists a long-felt need in the art for a foot-washing bowl system that can be used by users of differing heights. Further, there exists a long-felt need in the art for a foot-washing bowl system that is not heavy, is not large, and can be easily moved. In addition, there exists a long-felt need in the art for a foot-washing bowl system that can be easily used within a bathroom.

The subject matter disclosed and claimed herein, in one embodiment thereof, comprises a foot-washing bowl system. The system may be comprised of a free-standing foot-washing stand and/or a toilet-mounted foot-washing stand. The free-standing foot-washing stand has a bowl that receives a water source to allow water to flow through the stand and out at least one opening of a cross member to wash the feet of the user. In one embodiment, the legs of the stand are telescopic to allow the stand to adjust in height. The toilet-mounted embodiment features a stand identical to the free-standing stand that is further comprised of a toilet seat assembly that allows the system to attach and be used as a toilet seat.

In this manner, the foot-washing bowl system of the present invention accomplishes all of the foregoing objectives and provides a foot-washing bowl system that can be used by users of differing heights and physical abilities. Further, the system is not heavy, is not large, and can be easily moved. In addition, the system can easily be used within a bathroom, in a shower or on a toilet.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a foot-washing bowl system. The system is primarily comprised of at least one free-standing foot-washing stand or at least one toilet bowl-mounted foot-washing stand. The stand is comprised of at least one vertical member attached to at least one cross member of a frame of the stand. The vertical member is preferably hollow and has at least one continuous opening that extends from the first end to the second end. The vertical member may further have at least one handle with at least one grip.

The stand further has at least one bowl. The bowl has an exterior surface comprised of at least one vertical member that is preferably hollow and connects to a continuous opening that extends from the interior surface to the exterior surface. The vertical member can then be inserted into the second end of the vertical member. In this manner, the bowl rests within the vertical member in a removable fashion. One embodiment of the exterior surface is comprised of at least one tool such as, but not limited to: a foot brush, a foot file, etc. In one embodiment, the bowl can be removed such that the tool can be used on a foot of the user.

The stand is further comprised of at least one frame. A cross member of the frame may further be comprised of at least one opening that allows water from the water source to flow from the bowl, through the vertical member, and out the cross member such that a user can place their feet under or on the cross member to wash their feet. In one embodiment, the cross member may be comprised of at least one cleaning element that can further clean the feet of the user.

A second embodiment of the system is comprised of a toilet bowl-mounted foot-washing stand. This embodiment is identical in construction to the free-standing stand, with exception of the legs, which have at least one fastener. The stand is further comprised of a top toilet seat member that attaches to a bottom toilet seat member to form a toilet seat. The top surface of the bottom member has at least one fastener that engages at least one fastener on the bottom surface of the top member.

In one embodiment, the top member has the appearance and function of a normal toilet seat. In another embodiment, the top member has at least one cover that covers the portion of the member where a traditional opening would be in a traditional toilet seat and has an interior surface that slopes downwards toward at least one drain opening that allows water to drain down from the frame into the drain opening and into a toilet during use. In one embodiment, the legs may be fixedly attached to the top member (or removably via the fastener as noted). In this manner, when a user desires to wash his or her feet using this particular embodiment, the top member, which resembles and functions as a traditional toilet seat, can be removed from the bottom member and a replacement top member with a fixedly or removably attached frame, bowl, vertical member, etc., can be attached to the bottom member.

Accordingly, the foot-washing bowl system of the present invention is particularly advantageous as it provides a foot-washing bowl system that can be used by users of differing heights and physical abilities. Further, the system is not heavy, is not large, and can be easily moved. In addition, the system can easily be used within a bathroom, in a shower or on a toilet. In this manner, the foot-washing bowl system overcomes the limitations of existing foot-washing devices and practices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
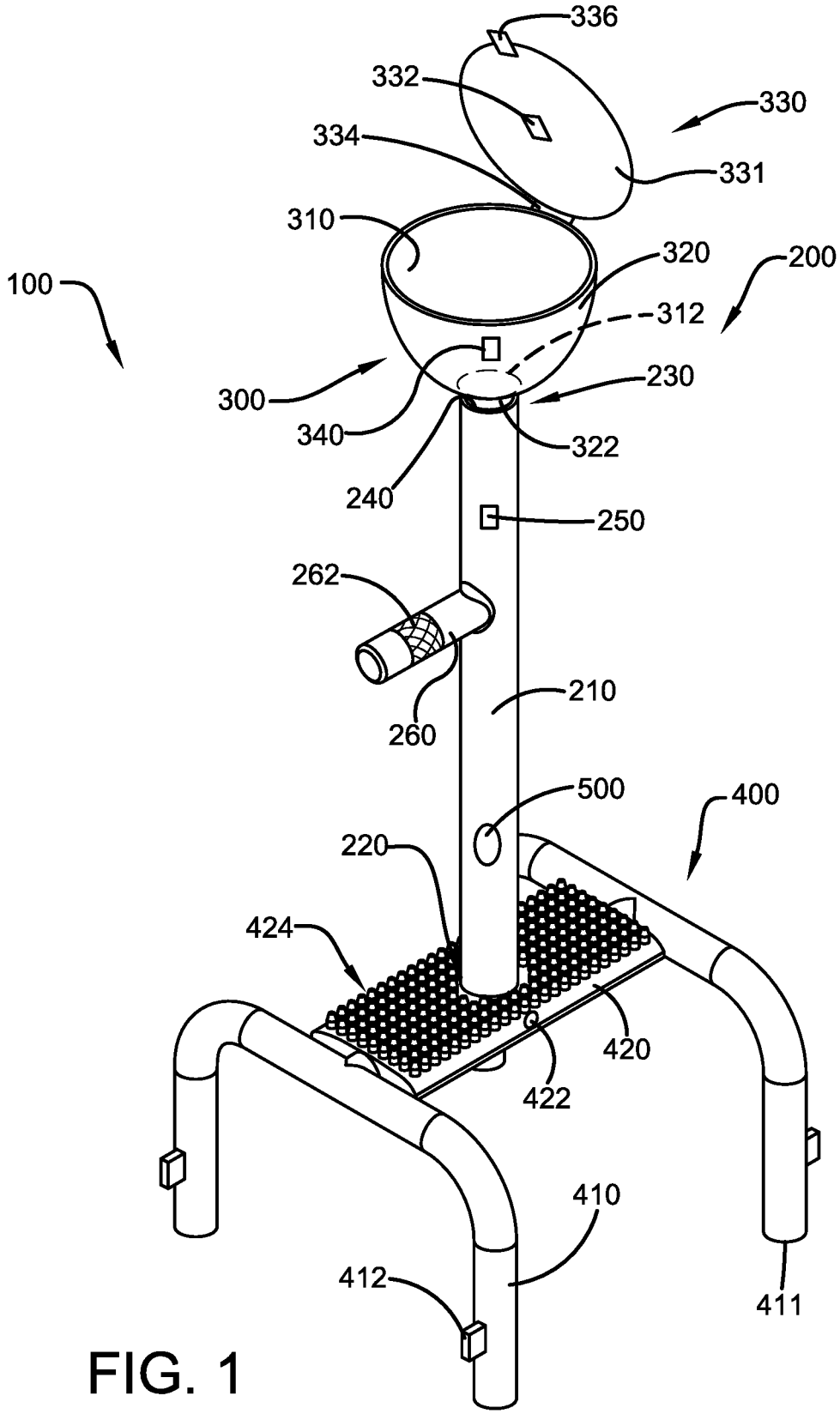
FIG. 1 illustrates a perspective view of one potential embodiment of a free-standing embodiment of a foot-washing bowl system of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an invention that allows a user to wash their feet. There also exists a long-felt need in the art for a foot-washing bowl system that can be used by users of differing heights. Further, there exists a long-felt need in the art for a foot-washing bowl system that is not heavy, is not large, and can be easily moved. In addition, there exists a long-felt need in the art for a foot-washing bowl system that can be easily used using existing water and drainage sources within a bathroom and which can be used for other related applications such as footrest multiple applications like leg shaving.

The present invention, in one exemplary embodiment, is comprised of a foot-washing bowl system comprised of a free-standing foot-washing stand and/or a toilet-mounted foot-washing stand. The free-standing foot-washing stand has a bowl that receives a water source to allow water to flow through the stand and out at least one opening of a cross-member to wash the feet of the user. The toilet-mounted embodiment features a stand identical to the free-standing stand that is further comprised of a toilet seat assembly that allows the system to attach and be used as a toilet seat.

Referring initially to the drawings, FIG. 1 illustrates a perspective view of one potential embodiment of a free-standing embodiment of a foot-washing bowl system 100 of the present invention in accordance with the disclosed architecture. The system 100 is primarily comprised of at least one free-standing foot-washing stand 200 or at least one toilet bowl-mounted foot-washing stand 600. Unless otherwise specified herein, all components of the system 100 are manufactured from a rigid plastic or semi-rigid such as collapsible plastic or hard water resistant paper and/or such as, but not limited to: acrylic, polycarbonate, polyethylene, thermoplastic, acrylonitrile butadiene styrene, low-density polyethylene, medium density polyethylene, high-density polyethylene, polyethylene terephthalate, polyvinyl chloride, polystyrene, polylactic acid, acetal, nylon, fiberglass, recycled plastic, biodegradable plastic, etc. The system 100 may also be made from a combination of plastic and metal.

The stand 200 is comprised of at least one vertical member 210. The first end 220 of the vertical member 210 is fixedly or removably attached to at least one cross member 420 of a frame 400 of the stand 200. The vertical member 210 is preferably hollow and has at least one continuous opening 240 that extends from the first end 220 to the second end 230. In one embodiment, the vertical member 210 is telescopic such that it is adjustable in overall height. The vertical member 210 may be locked into a specific telescopic position using at least one lock 250 found on the member 210. The lock 250 may be any lock type known in the art such as, but not limited to, a sliding lock or a push-button lock. The vertical member 210 may further have at least one handle 260 with at least one grip 262. The grip 262 may be textured (to aid a user in gripping) and made from a rubber material such as, but not limited to: natural rubbers, neoprene rubber elastomer, silicone rubber elastomer, ethylene propylene diene monomer rubber, butyl rubber, nitrile rubber, buna-n rubber, styrene-butadiene rubber elastomers, Viton rubber elastomer, diaphragm rubber, thermoplastic rubber, etc. The handle 260 allows the vertical member 210 to be easily maneuvered as needed.

The stand 200 further has at least one bowl 300. In differing embodiments, the bowl 300 may be any shape known in the art such as, but not limited to, polygonal, square, etc. However, in the preferred embodiment, the bowl 300 is half-spherical in shape. The bowl 300 has an interior surface 310 and an exterior surface 320. The exterior surface 320 is comprised of at least one vertical member 322. The vertical member 322 is preferably hollow and connects to a continuous opening 312 that extends from the interior surface 310 to the exterior surface 320. The vertical member 322 can then be inserted into the second end 230 of the vertical member 210. In this manner, the bowl 300 rests within the vertical member 210 in a removable fashion. In one embodiment, the bowl 300 is fixedly attached to the vertical member 210.

In another embodiment, the bowl 300 has at least one lid 330. The lid 330 attaches to the interior surface 310 or exterior surface 320 via at least one hinge 334 such as, but not limited to: an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc. The lid 330 may further be comprised of at least one lock 336 such as, but not limited to: a padlock, a deadbolt lock, a cam lock, a rim/mortise lock, a euro profile cylinder lock, an interchangeable core cylinder lock, a furniture latch lock, a rim latch lock, a biometric fingerprint scanning lock, an RFID key fob lock, a Bluetooth lock that unlocks via a smart device mobile application, a mechanical dial lock, a numerical combination lock, a pedestal lock, a draw lock, a fixed core lock, etc. The bottom surface 331 of the lid 330 is further comprised of at least one fastener 332 that secures a water source such as, but not limited to a hose, a showerhead, etc., to the lid 330. The fastener 332 may be any fastener known in the art such as, but not limited to: a clip, a tie, a magnet, etc. The fastener 332 thereby allows the water source to remain within the bowl 300 and provide water to the bowl 300 while the lid 330 is closed.

Further, in one embodiment the exterior surface 320 is comprised of at least one tool 340. Said tool 340 is preferably related to foot care or foot-washing. The tool 340 can include, but is not limited to: a foot brush, a foot file, etc. In another embodiment, the exterior surface 320 may be comprised of at least one opening, groove, or area 500 that can be used to store said tool(s) 340. In one embodiment, the bowl 300 can be removed such that the tool 340 can be used on a foot of the user. In another embodiment, the vertical member 210 and bowl 300 can be removed, wherein the handle 260 of the vertical member 210 can be used to use the tool 340.

The stand 200 is further comprised of at least one frame 400. As noted, the cross member 420 of the frame connects to the first end 220 of the vertical member 210. The cross member 420 is preferably hollow such that the bowl 300, the vertical member 210, and the frame 400 are in fluid communication. The cross member 420 may further be comprised of at least one opening 422. The opening 422 allows water from the water source to flow from the bowl 300, through the vertical member 210, and out the cross member 420. In this manner, a user can place their feet under or on the cross member 420 to wash their feet. In one embodiment, the cross member 420 may be comprised of at least one cleaning element 424. The cleaning element and/or massaging element may include, but is not limited to: at least one natural bristle, at least one synthetic bristle, at least one ridge, pumice stone, or any other foot-cleaning and/or massaging element or surface known in the art. In this manner, a user can also scrub, clean, and/or massage their feet while washing.

At least one leg 410 is further removably or fixedly attached to the cross member 420. The leg 410 may be of a fixed length or may be telescopic to adjust in height in the same manner and function as the vertical member 210. In one embodiment, the bottom surface 411 of the leg 410 is made from a non-slip material such as, but not limited to, a textured rubber material. This prevents the stand 200 from moving while in a wet environment such as a shower.

Figure 2:
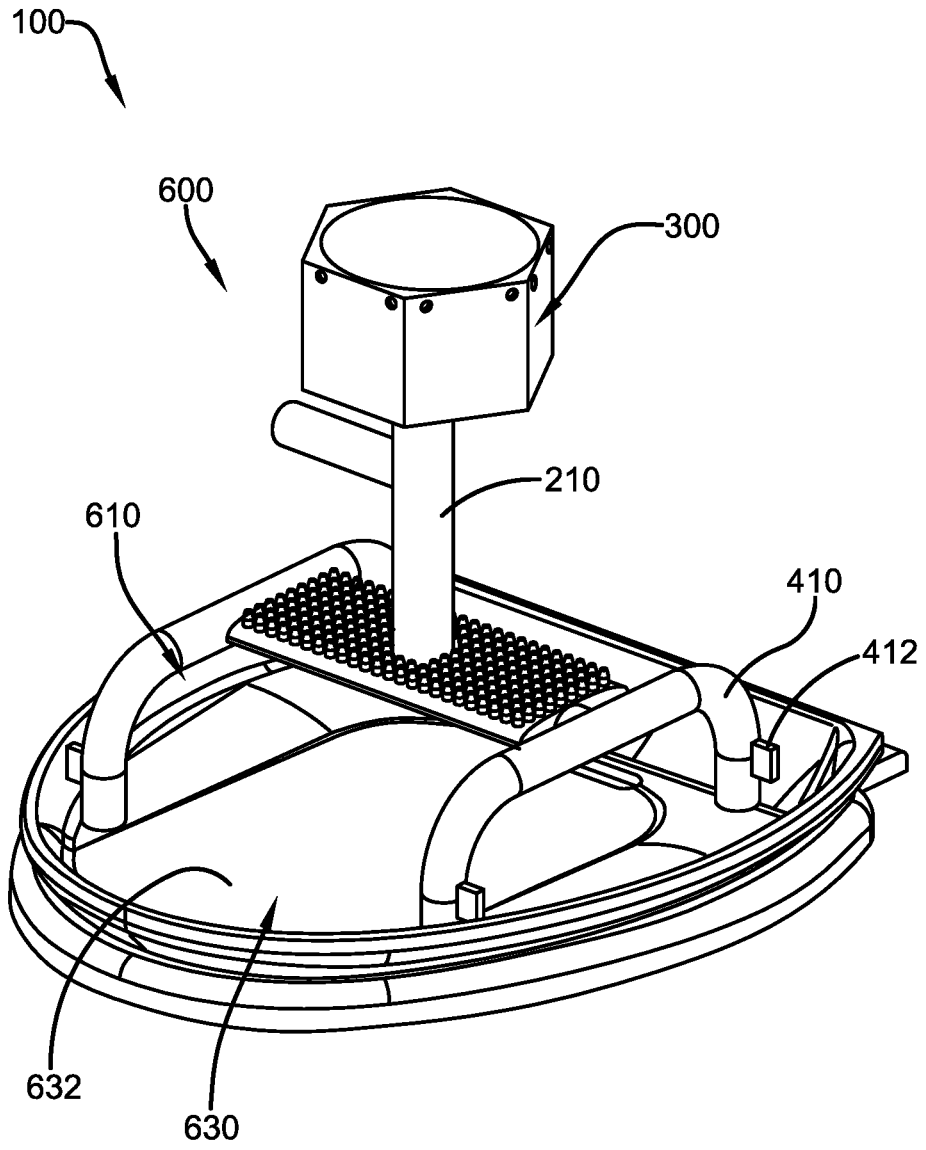
FIG. 2 illustrates a perspective view of one potential embodiment of a toilet bowl-mounted embodiment of a foot-washing bowl system of the present invention in accordance with the disclosed architecture.

The previously described embodiment of the stand 200 is designed to be free-standing. However, a second embodiment of the system 100 is comprised of a toilet bowl-mounted foot-washing stand 600, as seen in FIG. 2. The stand 600 is identical in construction to the free-standing stand 200, with exception of the legs 410. The legs 410 in the toilet embodiment 600 are further comprised of at least one fastener 412. In the preferred embodiment, the fastener 412 is a tab. In various embodiments, the fastener 412 may be a magnet, hook and loop, tongue and groove, snap-fastener, etc.

Figure 3:
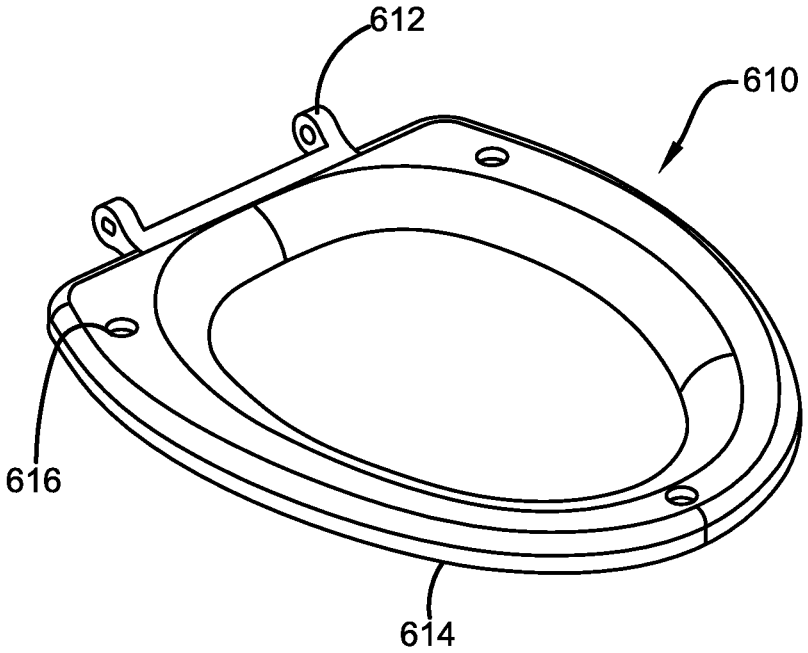
FIG. 3 illustrates an exploded view of a top toilet seat member and a bottom toilet seat member of one potential embodiment of a toilet bowl-mounted embodiment of a foot-washing bowl system of the present invention in accordance with the disclosed architecture.
Figure 3:
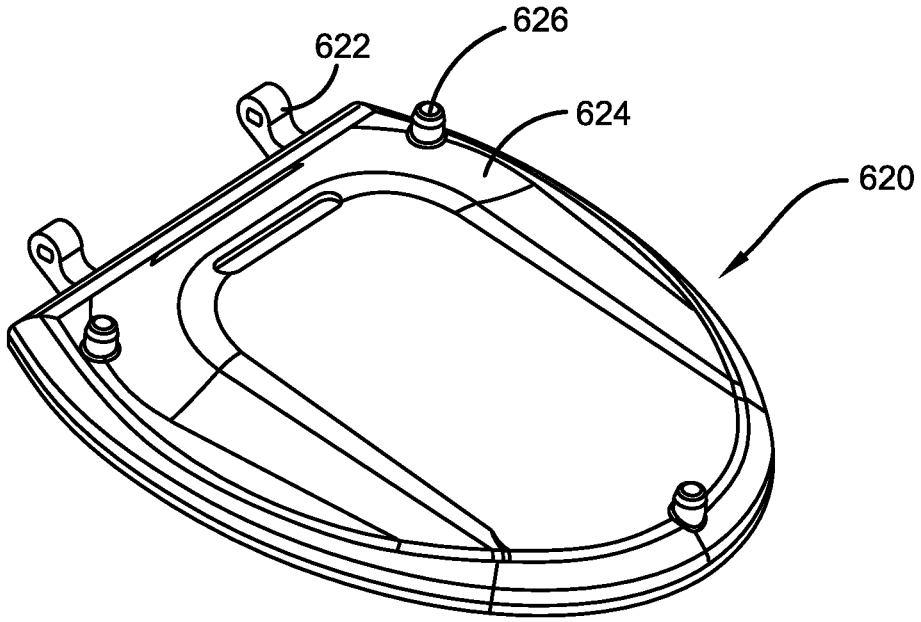

As seen in FIG. 3, the stand 600 is further comprised of a top toilet seat member 610 that attaches to a bottom foot washing member 620 to form a toilet the foot washing system 600. Both members 610,620 have at least one hinge tab 612,622 that allows the members 610,620 to be mounted to a hinge of a traditional toilet. In one embodiment, the members 610,620 may have no hinge tab 612,622 and may have a fastener 626 such as a pedestal to allow the members 610,620 to be placed on the floor. The top surface 624 of the bottom member 620 has at least one fastener 626 such as, but not limited to: a snap-fastener, a magnet, a tongue, etc., that engages at least one fastener 616 on the bottom surface 614 of the top member 610. Said fastener 616 may be any reciprocating fastener to the fastener 626 of the bottom member 620 known in the art. In this manner, the top member 610 and bottom member 620 can be removably attached to one another.

Figure 4:
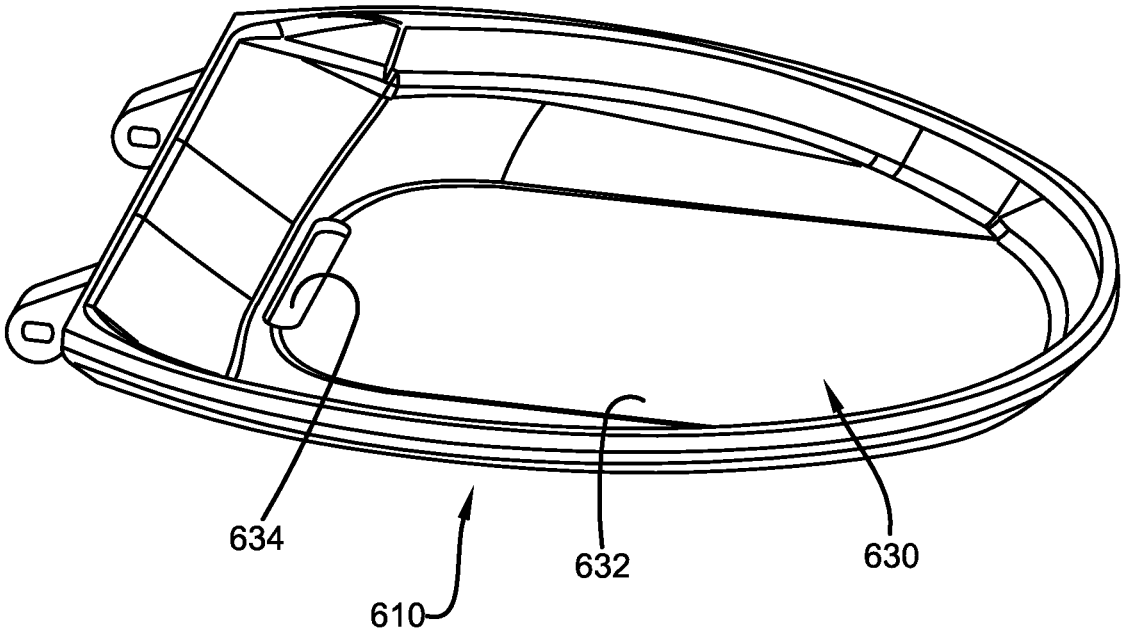
FIG. 4 illustrates a perspective view of a top toilet seat member and a lid of a top toilet seat member of one potential embodiment of a toilet bowl-mounted embodiment of a foot-washing bowl system of the present invention in accordance with the disclosed architecture.
Figure 4:
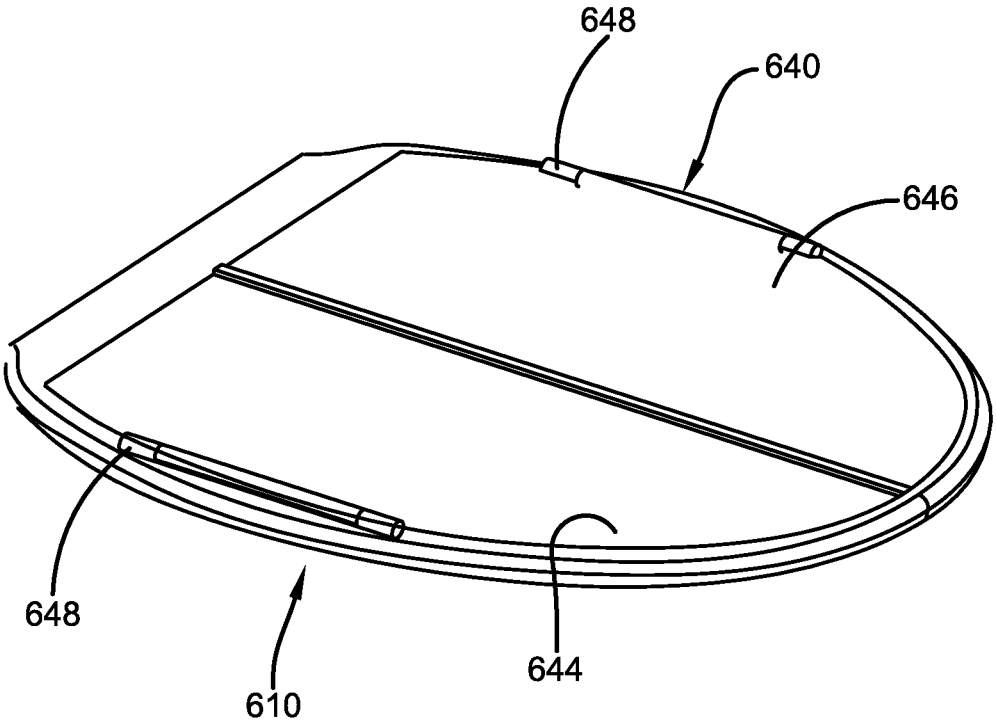
Figure 5:
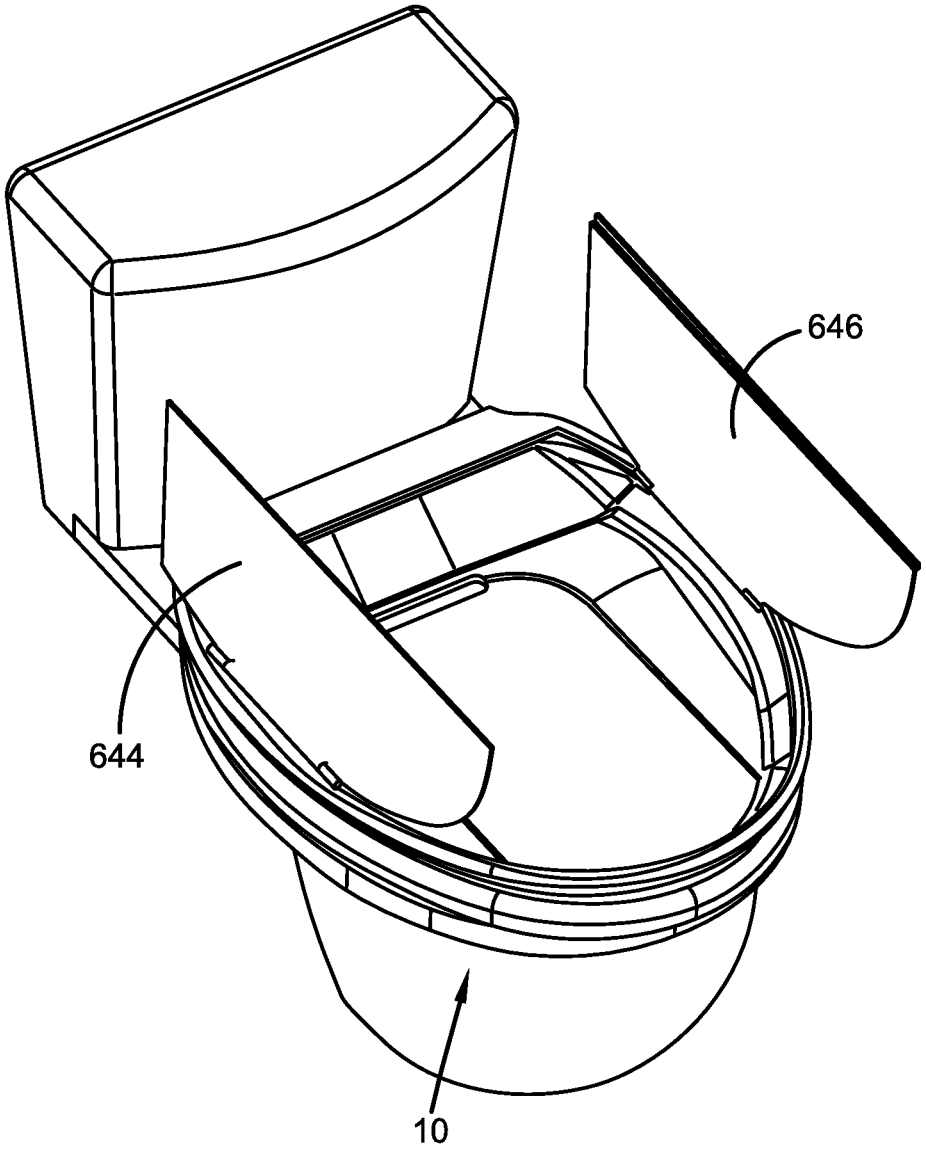
FIG. 5 illustrates a perspective view of a bottom toilet seat member, a top toilet seat member, and a lid of a top toilet seat member of one potential embodiment of a toilet bowl-mounted embodiment of a foot-washing bowl system of the present invention while attached to a toilet in accordance with the disclosed architecture.
Figure 7:
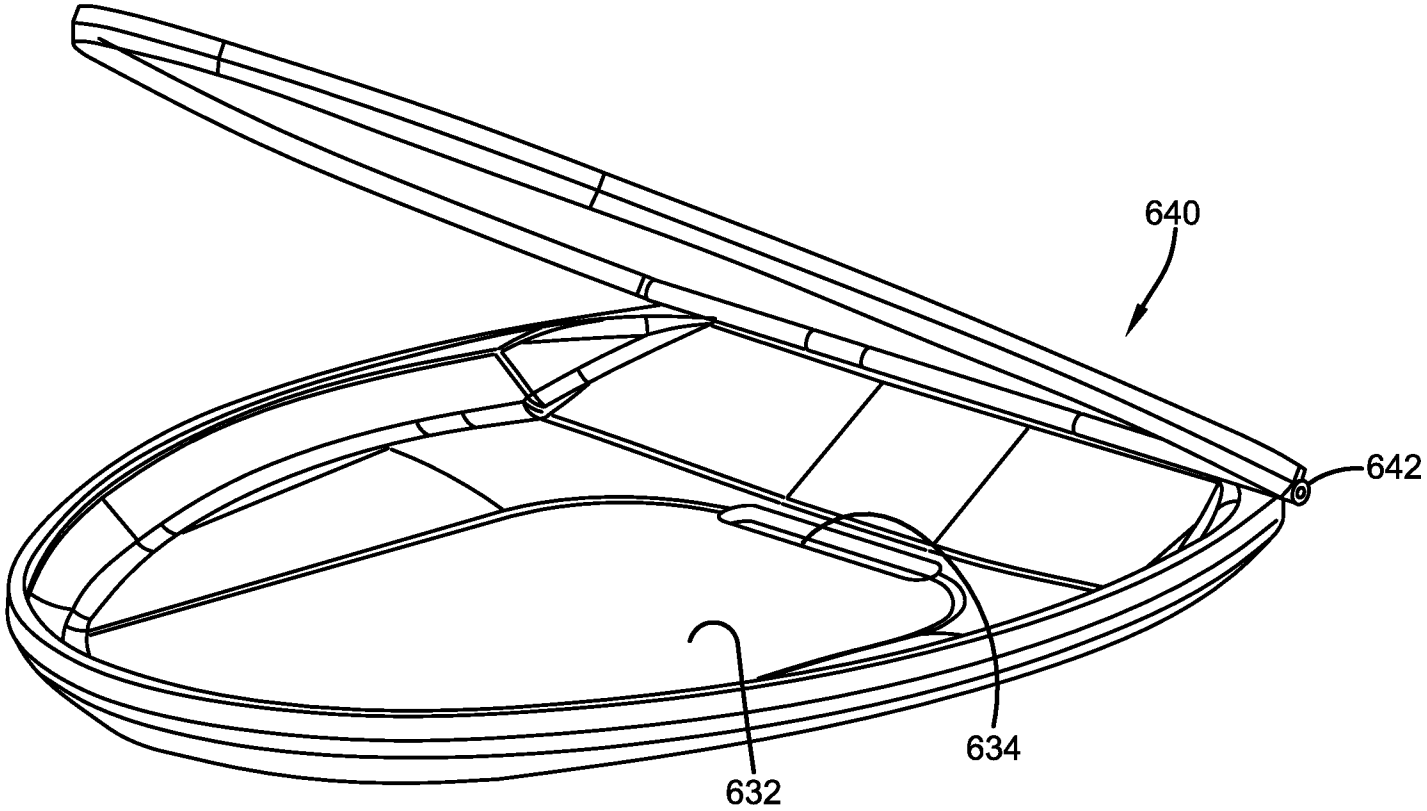
FIG. 7 illustrates a perspective view of a bottom toilet seat member, a top toilet seat member, and a lid of a top toilet seat member of one potential embodiment of a toilet bowl-mounted embodiment of a foot-washing bowl system of the present invention while attached to a toilet in accordance with the disclosed architecture.

In one embodiment, the top member 610 has the appearance and function of a normal toilet seat. In another embodiment, the top member 610 has at least one cover 630 that covers the portion of the member 610 where a traditional opening would be in a traditional toilet seat. The cover 630 has an interior surface 632 that slopes downwards toward at least one drain opening 634 that allows water from the frame 400 to drain down into the drain opening 634 and into a toilet during use, as seen in FIG. 4. In one embodiment, the legs 410 may be fixedly attached to the top member 610 (or removably via the fastener 412 as noted). In this manner, when a user desires to wash their feet using this embodiment 600, an embodiment of the top member 610 that resembles and functions as a traditional toilet seat can be removed from the bottom member 620 and a top member 610 with a fixedly or removably attached frame 400, bowl 300, vertical member 210, etc., can be attached to the bottom member 620. This embodiment 600 may also be comprised of at least one toilet lid 640 of any type known in the art that attaches to the hinge tabs 612,622 via at least one hinge pin 642, as seen in FIG. 7. In one embodiment, the lid 640 may have a first-half 644 and a second-half 646, each with its own hinge 648 or any hinge type known in the art, as seen in FIG. 4 and FIG. 5.

Figure 6:
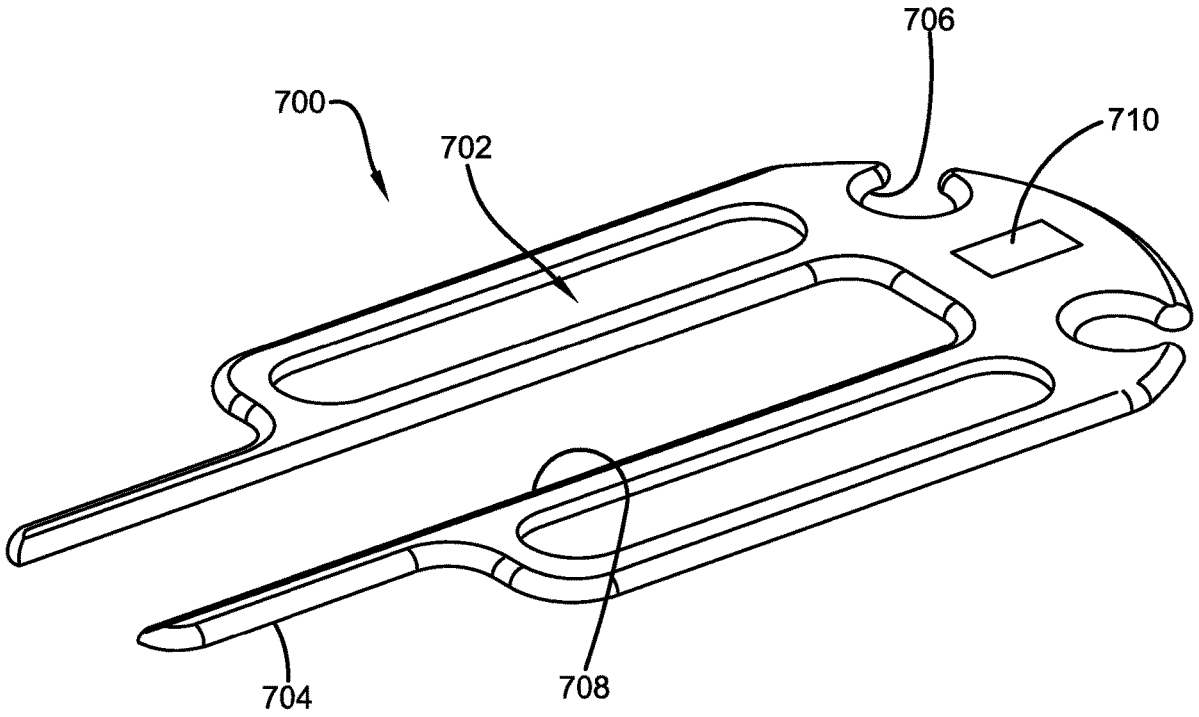
FIG. 6 illustrates a perspective view of a bracket extension of a toilet bowl-mounted embodiment of a foot-washing bowl system of the present invention while attached to a toilet in accordance with the disclosed architecture.

In one embodiment, the stand 200 and/or toilet stand 600 embodiments may be further comprised of at least one bracket extension 700 that has a platform 702 with an extended rectangular arm 704, as seen in FIG. 6. The platform 702 further has a shower head holder 706 that can be used to store a shower head. The rectangular arm 704 has at least one continuous cut 708 in the middle that can provide recess for the bracket bolts of the prior art bracket of toilet seat assembly. The platform 702 can receive items such as, but not limited to: a soap pan with soap, a liquid soap bottle, and other related aids required for foot care.

In another embodiment, the extension 700 may have a built-in soap pan 710, shower holder, and other similar aids required for foot care and washing. In some embodiments, the platform 702 has a plurality of openings and/or indentations 702 for receiving various items mentioned above. In one embodiment, the arm 704 can be inserted between the securing bracket of any prior art toilet seat assembly and a toilet bowl 10 of any conventional toilet bowl to secure the extension 700 while in use. The extension 700 also serves as a spacer between the toilet bowl 10 and bottom member 620.

Figure 8:
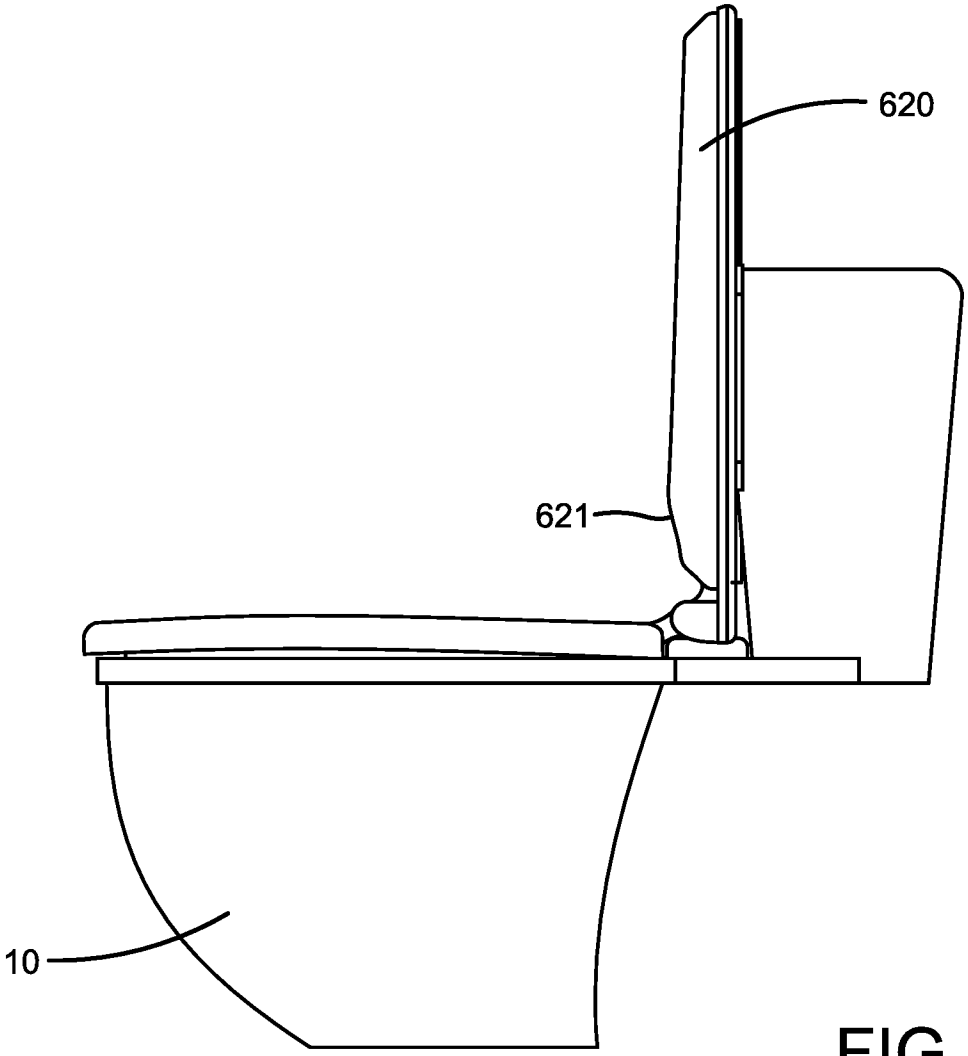
FIG. 8 illustrates a side view of a toilet bowl-mounted embodiment of a foot-washing bowl system of the present invention while attached to a toilet in accordance with the disclosed architecture.
Figure 9:
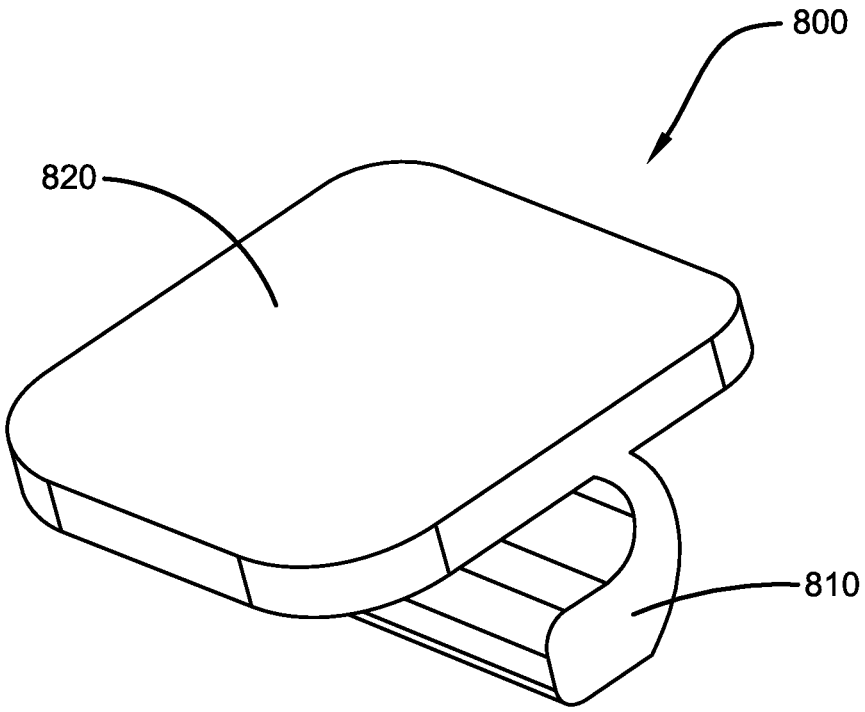
FIG. 9 illustrates a perspective view of a clip of a foot-washing bowl system of the present invention in accordance with the disclosed architecture.

Any embodiment of the system 100 may further feature at least one recessed opening, groove, or area that 500 that allows any foot-related tool to be stored within the opening/area 500. The opening 500 may further receive at least one clip 800. As seen in FIG. 9, the clip 800 has at least one round end 810 that can be placed into the opening 500 such that the clip 800 is retained within the opening 500. The clip 800 further has at least one platform 820 that can support any foot-related tool or product. Further, the bottom surface 621 of the bottom toilet seat member 620 (or any portion of the device 600) is tapered and/or sloped to provide lumbar support to the user while the device 600 is attached to a toilet bowl 10 but is raised and not being used, as seen in FIG. 8. The interior surface 632 may be sloped to provide the same lumbar-supporting effect, which is not found in prior art toilet seats.

Figure 10:
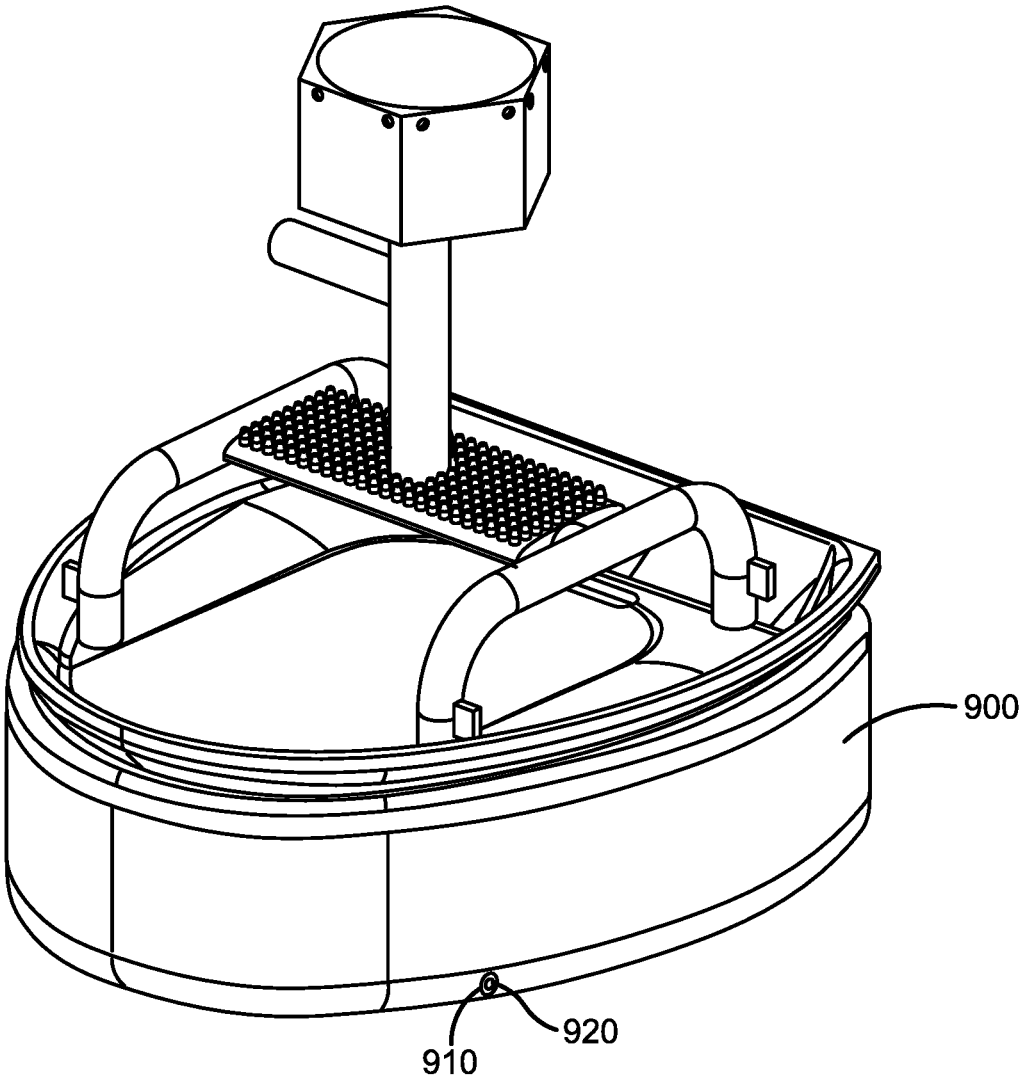
FIG. 10 illustrates a perspective view of a toilet bowl-mounted embodiment of a foot-washing bowl system of the present invention while attached to a drain bowl in accordance with the disclosed architecture.
Figure 11:
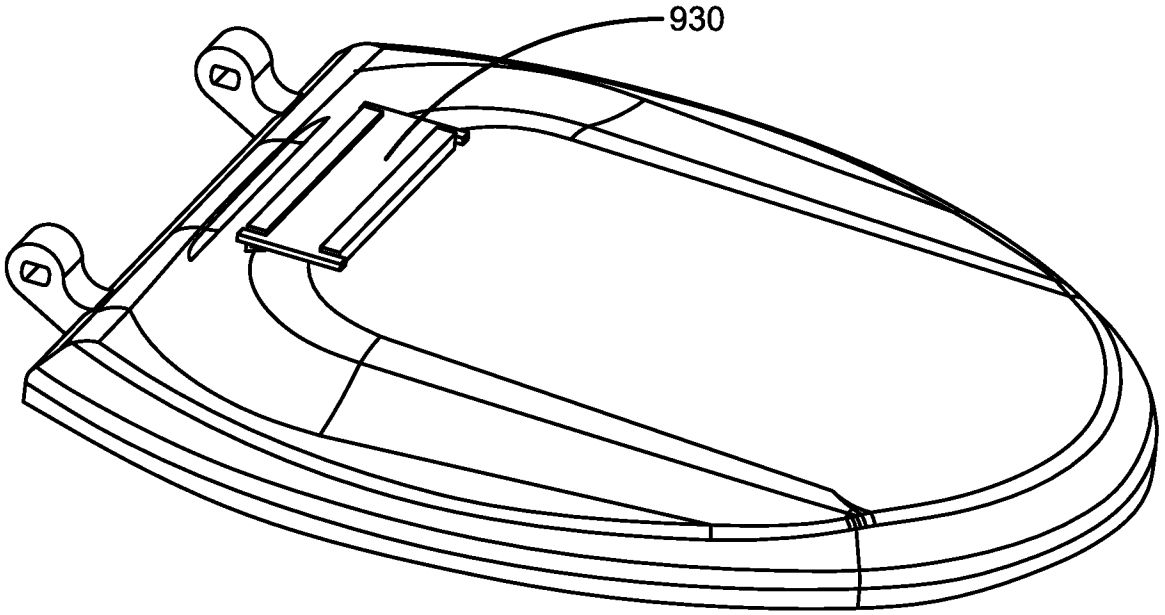
FIG. 11 illustrates a bottom perspective view of a drain cover in a closed position in a toilet bowl-mounted embodiment of a foot-washing bowl system of the present invention.
Figure 12:
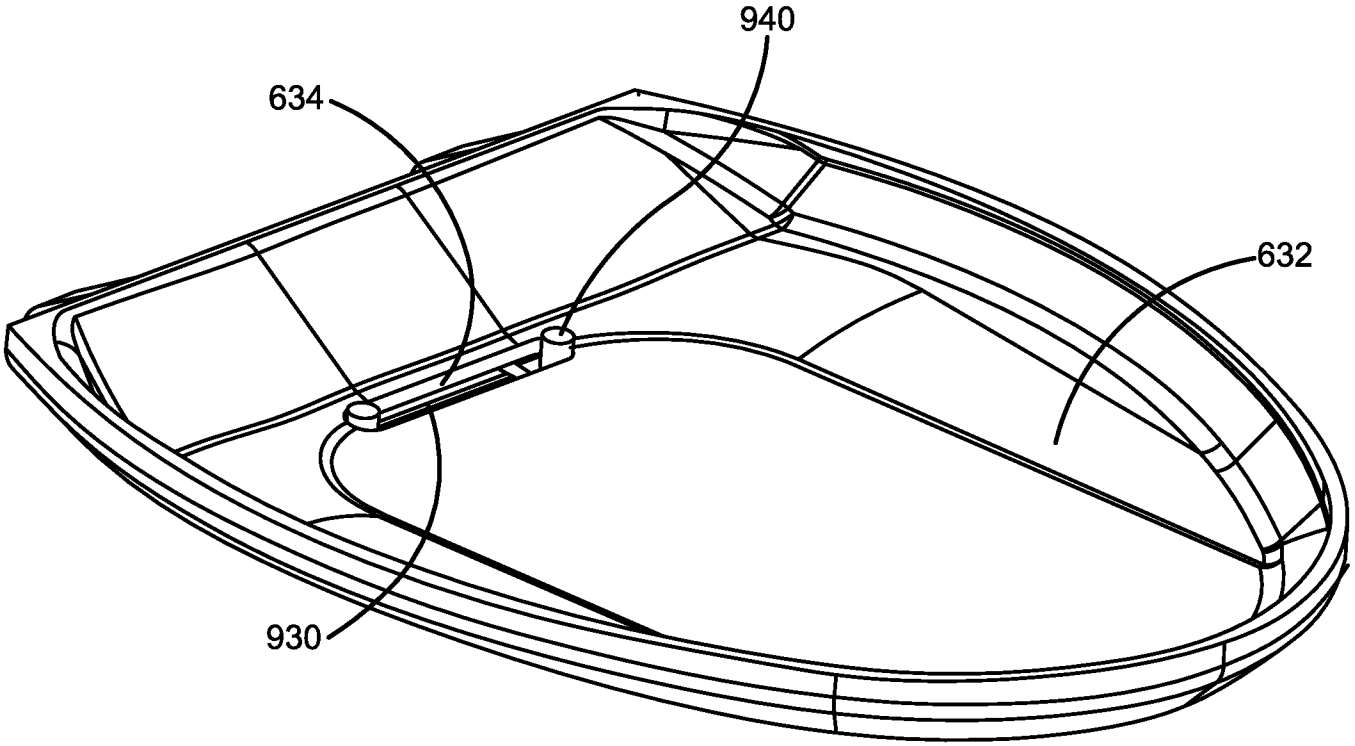
FIG. 12 illustrates a top perspective view of a drain cover in a closed position in a toilet bowl-mounted embodiment of a foot-washing bowl system of the present invention.

In one embodiment shown in FIG. 10, the device 600 and more specifically the toilet seat member 620 removably attached to at least one drain bowl 900. The drain bowl 900 collects water without the need for a toilet bowl 10. The drain bowl 900 may have at least one drainage opening 910 with at least one removable drain plug 920. The drainage opening 910 may have at least one drain cover 930, as seen in FIG. 11 and FIG. 12. The drain cover 930 can be positioned over the drainage opening 910 when the device 600 is not in use (wherein the device 600 can be used as a toilet lid) or in transit to prevent any water from spilling out of the opening 910. In the preferred embodiment, the drain cover 930 is a slidable cover with at least one handle 940 that aids a user in manipulating the cover 930 from open to closed. However, in differing embodiments the cover 930 may be any cover type known in the art such as but not limited to: a snap cover, a fastener cover, etc. The drain cover 930 can be used in any or all embodiments of top toilet seat member 610.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "foot-washing bowl system" and "system" are interchangeable and refer to the foot-washing bowl system 100 of the present invention.

Notwithstanding the foregoing, the foot-washing bowl system 100 of the present invention and its various components can be of any suitable size and configuration as is known in the art without affecting the overall concept of the invention, provided that they accomplish the above-stated objectives. One of ordinary skill in the art will appreciate that the size, configuration, and material of the foot-washing bowl system 100 as shown in the FIGS. are for illustrative purposes only, and that many other sizes and shapes of the foot-washing bowl system 100 are well within the scope of the present disclosure. Although the dimensions of the foot-washing bowl system 100 are important design parameters for user convenience, the foot-washing bowl system 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A foot-washing bowl system comprising:

a vertical member;

a frame comprised of a cross-member that attaches to the vertical member, an opening, and a leg;

a bowl positioned within the vertical member and comprised of a lid and a tool;

a top toilet seat member comprised of a first fastener;

a bottom toilet seat member comprised of a second fastener and a cover; and a bracket extension.

2. The foot-washing bowl system of claim 1, wherein the first fastener engages the second fastener.

3. The foot-washing bowl system of claim 1, wherein the cover is comprised of a drain opening.

4. The foot-washing bowl system of claim 3, wherein an interior surface of the cover slopes towards the drain opening.

5. The foot-washing bowl system of claim 1, wherein the foot-washing bowl system is comprised of a lid that attaches to each of the top toilet seat member and to the bottom toilet seat member.

6. The foot-washing bowl system of claim 1, wherein the bracket extension is comprised of an arm.

7. The foot-washing bowl system of claim 6, wherein the bracket extension is further comprised of a soap pan.

8. The foot-washing bowl system of claim 7, wherein the bracket extension is further comprised of a continuous cut.

* * * * *